United States Patent [19]

Faste et al.

[11] Patent Number: 4,523,622

[45] Date of Patent: Jun. 18, 1985

[54] METHOD OF MANUFACTURING HOLLOW METAL INGOTS

[75] Inventors: Heinrich Faste, Grossenkneten; Ali Bindernagel, Wermelskirchen, both of Fed. Rep. of Germany

[73] Assignee: Kocks Technik GmbH & Co., Hilden, Fed. Rep. of Germany

[21] Appl. No.: 589,514

[22] Filed: Mar. 14, 1984

Related U.S. Application Data

[63] Continuation of Ser. No. 396,845, Jul. 9, 1982, abandoned.

[30] Foreign Application Priority Data

Sep. 2, 1981 [DE] Fed. Rep. of Germany ..... 3134758

[51] Int. Cl.[3] ..... B22D 7/04; B22D 13/02

[52] U.S. Cl. ..... 164/66.1; 164/116; 164/DIG. 6

[58] Field of Search ..... 164/116, 66.1, DIG. 6

[56] References Cited

U.S. PATENT DOCUMENTS 3,683,999 8/1972 Kocks ..... 164/116 X
4,240,494 12/1980 Kryanin et al. ..... 164/66.1

FOREIGN PATENT DOCUMENTS 55-84260 6/1980 Japan ..... 164/66.1
415081 7/1974 U.S.S.R. ..... 164/66.1

*Primary Examiner*—Nicholas P. Godici
*Assistant Examiner*—J. Reed Batten, Jr.
*Attorney, Agent, or Firm*—Buell, Ziesenheim, Beck & Alstadt

[57] ABSTRACT

In the manufacture of hollow metal ingots, particularly for producing seamless tubes, the liquid melt is poured rapidly into an upright or slightly inclined chill mould, the chill mould is closed and is tilted into a substantially horizontal position in which it is slowly rotated about its longitudinal axis. The hole is produced in the hollow ingots by pouring into the chill mould a quantity of melt which corresponds to the total volume of the chill mould plus the shrinkage volume and less the volume of the desired hole. The method is particularly advantageous when manufacturing hollow ingots of great length, although the method can also be used when manufacturing short hollow ingots. It is particularly advantageous to blow in an accurately dimensioned quantity of inert gas, corresponding to the hole in the hollow ingot, during and after the actual pouring operation.

6 Claims, 17 Drawing Figures

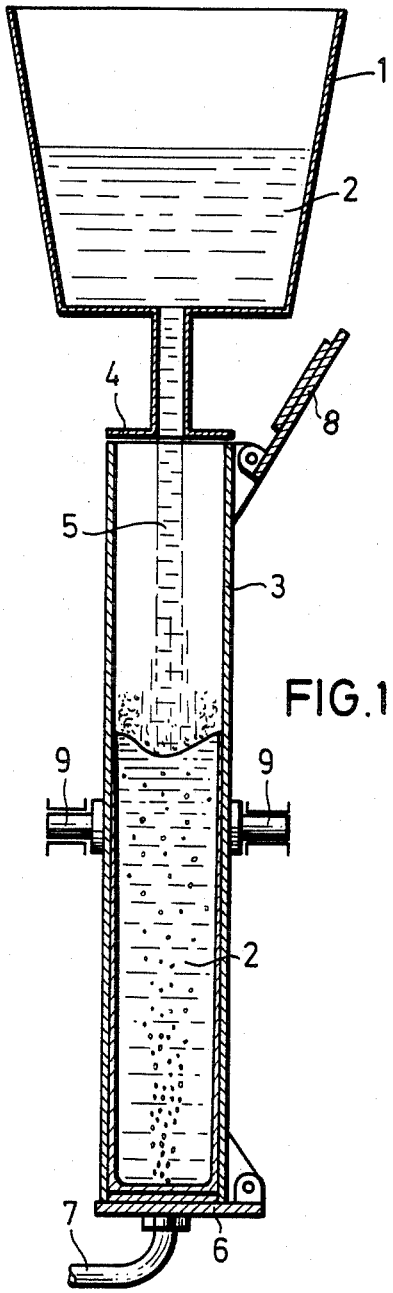
FIG.1
FIG.2
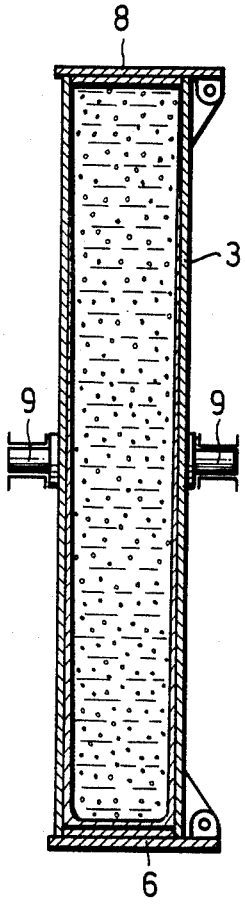

METHOD OF MANUFACTURING HOLLOW METAL INGOTS

This is a continuation of application Ser. No. 396,845, filed July 9, 1982 and now abandoned.

DESCRIPTION

The invention relates to a method of manufacturing hollow metal ingots, e.g. for producing seamless tubes, in which method the liquid melt is poured rapidly into an upright or slightly inclined chill mould, the chill mould is closed and is tilted into a substantially horizontal position in which it is slowly rotated about its longitudinal axis.

In a known method (German patent specification No. 24 34 850) of this kind, at least one mandrel is pushed in a longitudinal direction into a still molten or plastic core zone of the solidifying casting, the mandrel thereby being guided by the cooler and more solid peripheral zone, in order to produce the concentric hole in the hollow ingot. The casting, with the mandrel located in the interior thereof, is then fed to an apparatus, preferably a detaching rolling mill, for further processing the casting to form the tube, the casting subsequently being freed from the mandrel.

An object of the invention is to improve the above-mentioned known method, and particularly to avoid the use of piercing mandrels.

In accordance with the invention, there is provided a method of manufacturing hollow metal ingots, in which a liquid melt is poured rapidly into an upright or slightly inclined chill mould, and the chill mould is closed and is tilted into a substantially horizontal position in which it is slowly rotated about its longitudinal axis, and in which the quantity of melt poured into the chill mould corresponds to the total volume of the chill mould plus the shrinkage volume minus the volume of the desired hole so that the desired hole is formed by progressive solidification of the melt inwardly from the walls of the chill mould.

As a result of this, the chill mould is filled with exactly the quantity of metal to be contained in the desired hollow ingot. If a chill mould filled with this quantity of melt is treated in the same manner as in the known method, in which the melt is poured into the chill mould rapidly, that is to say, at a rate of pouring of approximately 25 meters per minute and in excess thereof, the chill mould then being closed and, together with the melt, immediately thereafter being tilted or swung into a substantially horizontal position in which it is slowly turned about its longitudinal axis, a hollow body is then obtained which has a central hole extending over almost the entire length of the hollow body, without having to use a mandrel for this purpose. Thus, it is a matter of combining the dimensioning, in accordance with the invention, of the melt and the use of the above-mentioned known processing features. In this manner, the reduction of volume resulting from shrinkage during cooling and conversion is transferred to the interior of the ingot produced, such that the reduction in volume leads to the formation of the elongate, concentric and uniform hole. A hole having a substantially circular cross section is produced which is disposed very concentrically around the central longitudinal axis of the chill mould, without having to use a mandrel for this purpose, particularly when heat is dissipated uniformly, this being dependent upon the construction and cooling of the chill mould. Thus, advantageously, all the disadvantages are avoided including the entire expenditure associated with the use of mandrels. Substantial capital expenditure and operating costs can be saved. The diameter of the hole can be varied in a simple manner by varying the quantity of melt introduced. The method in accordance with the invention can also be used to manufacture relatively thin-walled hollow ingots in which the ratio of the internal diameter to the external diameter is greater than approximately 0.7.

It is particularly advantageous if a quantity of inert gas completely filling the remaining space in the chill mould is blown into the melt poured into the chill mould, preferably from below. As a result of this predetermined quantity of inert gas, the quantity, in accordance with the invention, of melt completely fills the entire interior space of the chill mould at the end of the pouring operation, since the melt is permeated by the bubbles of the inert gas and, consequently, the volume of the melt has apparently increased. When the chill mould is then closed and is swung into a substantially horizontal position in which it is slowly rotated about its longitudinal axis, the inert gas accumulates in the region of the central longitudinal axis where it assists the formation of the desired hole and prevents oxidation of the wall of the hole. The blowing-in of the accurately dimensioned quantity of inert gas resulting from the difference between the volume of the chill mould and the quantity, in accordance with the invention, of the melt, is particularly advisable when it is desired to obtain a substantially larger hole than that which would result solely by the shrinkage of the melt introduced into the chill mould. If no inert gas, or far too small a quantity thereof were blown in, the chill mould would not be completely filled at the end of the filling operation upon closing and swinging the chill mould to the horizontal, so that the top end wall of the head of the ingot, which is the first to solidify at the end of the casting operation, would be pierced by the pressure of the molten melt which would then flow into the partial volume of the chill mould which has remained free. This melt can then penetrate into the gap formed between the ingot and the interior wall of the chill mould by shrinkage of the cast ingot. Even with a depth of penetration of only 20 to 50 millimeters, this operation can lead to jamming of the head of the ingot in the chill mould, which frequently leads to shrinkage cracks or to the breaking-off of the head of the ingot during further cooling of the ingot. However, all these difficulties can be avoided by introducing a predetermined quantity of inert gas. It is advantageous for the inert gas to be blown into the melt during the casting operation. This has the advantage that the considerable turbulence occurring during the casting operation prevents the bubbles of inert gas from being held back in the region of the edge zones until they are occluded by the solidified material. On the contrary, the turbulence caused by the pouring stream moves the bubbles away from the gradually solidifying edge zone towards the inside where the melt remains molten for a longer period of time and where the desired hole is gradually formed.

In a further development of the invention, the chill mould may be tilted into a position which differs from the horizontal by up to three degrees. When the chill mould is rotated slowly about its longitudinal axis when in this slightly inclined position, instead of in an exactly horizontal position, a hole of circular cross section is also obtained in the region of the central longitudinal axis, although this hole is of conical configuration dependent upon the chosen inclination. The angle differing from the horizontal corresponds to approximately half the angle of taper of the conical hole which is then produced. The chill mould can then have interior surfaces which extend parallel, or alternatively, at an angle to the central longitudinal axis. In this manner, it is possible to produce hollow ingots which are best suited to the manufacture of conical tubes or which, in the case of conical chill moulds, have uniform wall thicknesses or uniform wall cross-sectional areas over the length of the ingot.

The method in accordance with the invention is further described, by way of example, with reference to the accompanying diagrammatic drawings, in which:

FIG. 1 is a vertical section of a chill mould during the pouring operation;

FIG. 2 shows the chill mould of FIG. 1, after the chill mould has been closed;

Figure 3:
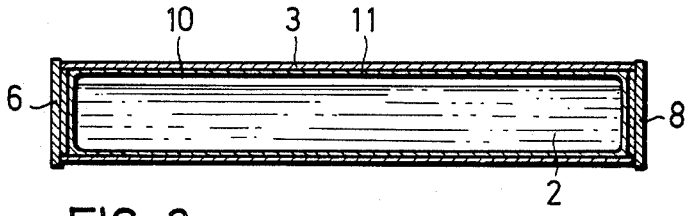
FIGS. 3 to 10 show the chill mould after it has been tilted to the horizontal and at various instants whilst it is being slowly rotated.

Referring to FIG. 1, we will describe the invention as applied to an iron base melt wherein a melt 2 flows at a high speed from a casting ladle 1 into a chill mould 3 which is substantially upright. As a result of this high speed, a high pouring rate is also achieved at which the surface of the bath in the chill mould rises by, for example, 25 m per minute and in excess thereof. The mouth of the chill mould is closed off by a plate 4 secured to the casting ladle 1, so that only the pouring stream 5 of the melt 2 can enter the interior of the chill mould, although the atmospheric oxygen is prevented from entering the chill mould. A hinged base 6 of the chill mould seals the interior space of the chill mould at the bottom thereof and prevents the melt 2 from running out. A predetermined quantity of inert gas is blown into the melt 2 by way of a line 7 in the base 6 of the chill mould and is distributed within the melt 2 in the form of small gas bubbles.

After the casting operation has been completed, a cover 8 secured to the chill mould 3 is closed and the chill mould 3 is then immediately tilted about two pivot pins 9 into a substantially horizontal position. The operations during casting can be envisaged substantially as follows:

The falling casting stream 5 almost completely fills the cross section of the chill mould, particularly in the region of the bottom half of the chill mould. Owing to the absence of oxygen, the splashes striking the wall of the chill mould are not oxidized and, owing to the high pouring speed, are completely remelted in the melt. A two-phase, viscous layer forms after a short interval of time with direct contact between the molten metal and the wall of the chill mould, and a solid crust is finally formed with gapless contact between the crust and the wall of the chill mould. In contrast to conventional top-casting of ingots, the solid crust forms somewhat later in the present instance, since the considerable turbulence caused upon the impingement of the casting stream ensures continuous dissipation of heat from the centre of the chill mould owing to the high pouring rate. The ferrostatic forces acting upon the solid crust in the casting state shown in FIG. 1 are large, particularly in the case of very long ingots, and delay the lifting-off of the crust from the wall of the chill mould despite the large decrease in volume when passing through the $\delta$ region and the upper $\gamma$ region. Tilting of the chill mould 3 into the horizontal within a period of time of less than 60 seconds after the commencement of casting leads to an abrupt decrease in the ferrostatic pressure and thus to the lifting-off of the crust from the wall of the chill mould and initiates the formation of an all-round gap.

Figure 4:
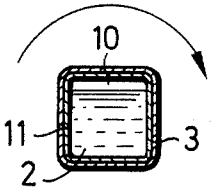
Figure 5:
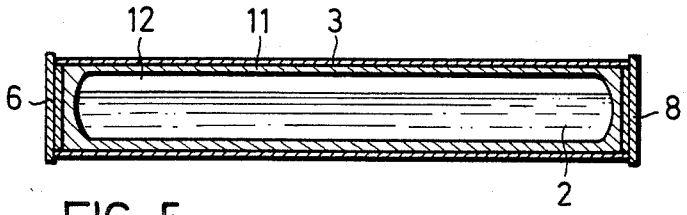
Figure 6:
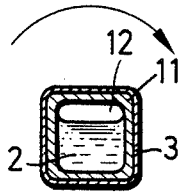

As will be seen in FIGS. 3 to 10, the chill mould 3 is slowly turned about its longitudinal axis in an approximately horizontal position. The rotational speed is sufficiently low to avoid any appreciable centrifugal forces. FIGS. 3 and 4 clearly show a gap 10 formed by reason of the shrinkage of the melt 2 which has solidified to form a thin crust 11 only in the immediate vicinity of the wall of the chill mould. This crust 11 has become perceptibly thicker at a somewhat later instant (see FIGS. 5 and 6) due to the progressive solidification, so that a cavity 12 of considerable dimensions has been formed from the original gap 10. However, the cavity 12 is still located above the central longitudinal axis of the chill mould 3 which continues to rotate.

Figure 7:
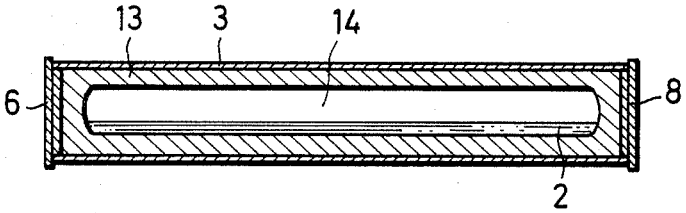
Figure 8:
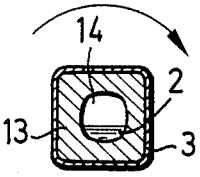
Figure 9:
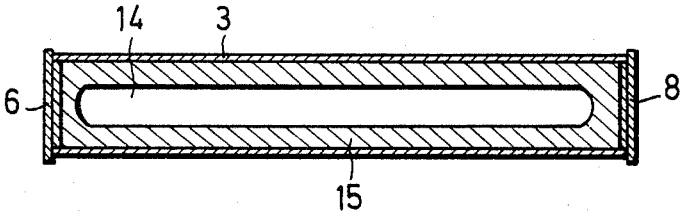
Figure 10:
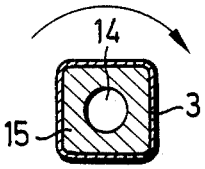
Figure 11:
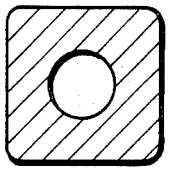
FIGS. 11 to 17 show various cross sections through hollow ingots cast by the method in accordance with the invention.
Figure 12:
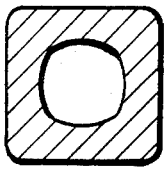
Figure 13:
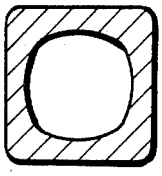
Figure 14:
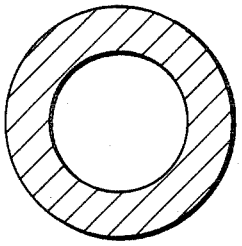
Figure 15:
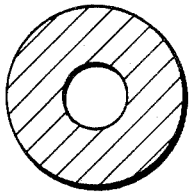
Figure 16:
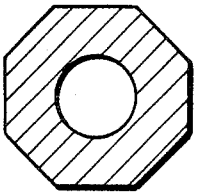
Figure 17:
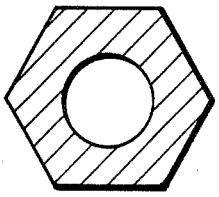

FIGS. 7 and 8 show an even later state in which the melt 2 has already formed a relatively thick wall 13 by the continued progressive solidification, and in which only a small quantity of molten metal 2 is present. The hole 14, disposed concentrically of the central longitudinal axis of the chill mould 3, has been formed from the cavity 12 as a result of the rotary movement of the chill mould 3 about its central longitudinal axis. The inert gas contained in the melt 2 is located within the hole 14 or still within the melt 2 which, however, is gradually decreasing, while the wall of the ingot 13 is increasing. FIGS. 9 and 10 show the chill mould 3 containing a solidified hollow ingot 15 which has a concentric hole 14 of circular cross section. The ingot 15 is ejected from the chill mould 3 after the melt 2 has fully solidified, and the chill mould 3 can be reused after maintenance has been carried out.

The hollow ingot produced in this manner has satisfactory interior and exterior surfaces, this being substantially attributable to the rotary movement of the chill mould 3 during solidification of the ingot 15. A different side of the ingot 15 continuously comes into abutment against the wall of the chill mould as a result of the slow rotary movement. Any catching or hooking of the ingot on unevenesses of the interior surface of the chill mould is thereby continuously rendered ineffective, and the friction obstructing shrinkage of the ingot 15 is reduced. Thermal cracks, fractures, bubbles and other surface irregularities are avoided.

FIGS. 11 to 17 show cross-sectional shapes of hollow ingots which, for example, can be produced by the method in accordance with the invention. A large number of other cross-sectional shapes is also conceivable.

We claim:

1. A method of manufacturing hollow metal ingots comprising the steps of:

(a) rapidly pouring a liquid metal melt into an upright or slightly inclined chill mould, the quantity of liquid metal poured into the mould corresponding to the total volume of the chill mould plus the shrinkage volume minus the volume of the desired axial hole in the final casting;

(b) closing said chill mould;

(c) tilting the closed chill mould into a substantially horizontal axial position;

(d) slowly rotating the chill mould about its longitudinal axis at a speed sufficiently low to avoid any appreciable centrifugal forces; and (e) progressively cooling and solidifying the metal inwardly from the walls of the rotating chill mould during said slow rotation to form a hollow casting having the length and form of the chill mould and the desired axial passage whereby the casting is substantially free from centrifugally created effects.

2. A method as claimed in claim 1, in which a quantity of inert gas completely filling the remaining space in the chill mould is blown into the melt poured into the chill mould.

3. A method as claimed in claim 2, in which the inert gas is blown into the melt during the pouring operation.

4. A method as claimed in claim 2 or 3 in which the inert gas is blown into the melt from below.

5. A method as claimed in claim 1 or 2 or 3, in which the chill mould is tilted into a position which differs from the horizontal by up to three degrees.

6. A method as claimed in claim 4 in which the chill mould is tilted into a position which differs from the horizontal by up to three degrees.

* * * * *